US007274624B2

(12) United States Patent
Gueissaz

(10) Patent No.: US 7,274,624 B2
(45) Date of Patent: Sep. 25, 2007

(54) TIMEPIECE WITH POWER-RESERVE INDICATION

(75) Inventor: Francois Gueissaz, Wavre (CH)

(73) Assignee: Asulab S.A., Marin (CH)

( * ) Notice: Subject to any disclaimer, the term of this patent is extended or adjusted under 35 U.S.C. 154(b) by 294 days.

(21) Appl. No.: 11/011,552

(22) Filed: Dec. 15, 2004

(65) Prior Publication Data

US 2005/0128881 A1 Jun. 16, 2005

(30) Foreign Application Priority Data

Dec. 16, 2003 (EP) ..... 03104738

(51) Int. Cl.
*G04C 3/00* (2006.01)

(52) U.S. Cl. ..... 368/204; 368/66

(58) Field of Classification Search ..... 368/204, 368/203, 64, 66

See application file for complete search history.

(56) References Cited

U.S. PATENT DOCUMENTS

| | | | | |
|---|---|---|---|---|
| 3,937,001 | A | 2/1976 | Berney | |
| 5,699,322 | A * | 12/1997 | Born | 368/66 |
| 5,751,666 | A * | 5/1998 | Farine et al. | 368/140 |
| 6,208,119 | B1 * | 3/2001 | Schafroth | 322/29 |
| 6,678,218 | B2 * | 1/2004 | Serex et al. | 368/160 |
| 6,826,124 | B2 * | 11/2004 | Born | 368/66 |
| 6,829,199 | B2 * | 12/2004 | Shimizu et al. | 368/64 |
| 6,958,954 | B2 * | 10/2005 | Haeni et al. | 368/66 |
| 2002/0136151 | A1 | 9/2002 | Serex et al. | |

FOREIGN PATENT DOCUMENTS

| | | | | |
|---|---|---|---|---|
| CH | 597 636 | | 4/1978 | |
| CH | 686 332G | A3 | 3/1996 | |
| EP | 0 762 243 | A1 | 3/1997 | |
| EP | 0 848 306 | A1 | 6/1998 | |
| EP | 0 875 807 | A1 | 11/1998 | |
| EP | 1 239 350 | A2 | 9/2002 | |
| WO | WO 02/35296 | * | 2/2002 | 368/66 |

OTHER PUBLICATIONS

Austrian Search Report issued in corresponding Austrian application No. 200407717-8, mailed Jul. 22, 2005.
European Search Report, completed May 27, 2004.

* cited by examiner

*Primary Examiner*—Vit Miska
*Assistant Examiner*—Sean Kayes
(74) *Attorney, Agent, or Firm*—Griffin & Szipl, P.C.

(57) ABSTRACT

The invention concerns a timepiece including a mechanical power source (1) coupled, on the one hand, to first means (5) displaying time related information and, on the other hand, to a generator (2), a regulator circuit (6) for enslaving the generator frequency to a reference frequency, said regulator circuit including switching means (7) arranged for electrically braking the generator when the generator frequency is higher than the reference frequency, and second power-reserve display means (12*a*) controlled by means for measuring the power-reserve (12*b*), said timepiece being characterized in that it further includes means (11) for accumulating the electrical energy dissipated during the generator braking periods and means (13) for actuating said second display means to display the power-reserve by means of the electrical energy accumulated.

17 Claims, 5 Drawing Sheets

TIMEPIECE WITH POWER-RESERVE INDICATION

This application claims priority from European Patent Application No. 03104738.4 filed Dec. 16, 2003, the entire disclosure of which is incorporated herein by reference.

FIELD OF THE INVENTION

The present invention concerns, generally, a timepiece with a micro-generator with a power-reserve indicator. The invention concerns more particularly means for providing this power-reserve indication. It also concerns the implementation method for indicating the power-reserve.

BACKGROUND OF THE INVENTION

There is known from the prior art, particularly from EP Patent No. 0 762 243 in the name of the present Applicant, a timepiece, shown in FIG. 1, including a mechanical power source, formed by a barrel 1 which houses a manually or automatically wound spring 1*a*, the winding device not being shown here.

Barrel 1 is mechanically coupled to magnetized rotor 2*a* of an electric generator 2 via gear trains 3. Generator 2 includes at least a coil 2*b* which generates an alternating voltage Ug, when magnetized rotor 2*a* is driven in rotation, generating a magnetic field symbolized by means of an arrow and to which said at least one coil 2*b* is coupled.

The terminals of coil 2*b* (or coils) are connected to a rectifier 4 supplying at its output a rectified voltage Ua, for powering regulator circuit 6, which will be discussed hereinafter.

Analog display members for a time indication 5, typically a set of hands or any other conventional mechanical time display means, are mechanically coupled to the barrel via the gear trains 3 of the movement and they are connected in rotation to rotor 2*a*. The rotational speed of hands 5 is kept at a constant mean value owing to regulator circuit 6, which is for enslaving the generator frequency to a reference frequency, such that the speed of the hands corresponds to the speed required to obtain a correct time indication.

This regulator circuit 6 will not be described in detail here, since those skilled in the art can design such an enslaving device by referring to the description of the Swiss Patent Application No. 686 332 in the name of the present Applicant. However, in order to facilitate comprehension, the essential elements of this circuit and the operation thereof will be recalled here.

This regulator circuit 6 includes an oscillator 6*a* stabilized by a clock type quartz and a frequency divider 6*b* bringing the frequency of oscillator 6*a* to a frequency that can be used by a logic circuit 6*c*, which controls, via a control signal, a switching member 7, for example a transistor, for braking generator 2 in order to regulate its frequency to a reference frequency advantageously corresponding to a correct time indication by the time indication display members 5.

The timepiece according to this document also includes a power-reserve indicator 9. This device includes a counter 9*a* counting the successive braking signals 8 during a determined period of time by means of an additional frequency divider 9*b*. A memory 9*c* is connected at output to counter 9*b* so as to store the date counted during the determined time period, to the output of which a decoder 9*d* is connected, converting the stored data into a power-reserve display means control signal 9*e* including successive dashes which are illuminated or appear up to a point corresponding to the value of the measured or calculated variable, accomplished either by a colored strip, or a liquid crystal cell.

The solution recommended in EP Patent No. 0 762 243 has, however, the drawback of directly using the generator power to provide the power-reserve indication, which has the effect of increasing the total power drawn from the generator, i.e. the power necessary to provide the type indicator and the power necessary to provide the power-reserve indication. Thus, in most cases, the total power necessary represents an instantaneous power greater than the maximum capacity that the generator can provide, which may prove harmful, on the one hand, to the accuracy of the time indication and, on the other hand, to the actual supply of the power-reserve indication. And, at best, for those cases where the indications provided remain correct, the autonomy of the timepiece is greatly reduced.

There is also known from the prior art, particular from EP Patent No. 0 875 807 filed in the name of the present Applicant, a timepiece whose generator autonomy is Higher. Such a timepiece, shown in FIG. 2, includes, in addition to known elements, which have the same reference numerals and were already described with reference to FIG. 1, a storage device 10 for storing and returning the electrical energy formed by a part of the electrical energy of generator 2. This storage device 10 connected to the terminals of rectifier 4 includes a conventional accumulator 10*a*.

When the barrel spring 1*a* is completely let down and rotor 2*a* of generator 2 is not rotating, voltage Ug is obviously zero. If, moreover, accumulator 10*a* of storage device 10 is discharged, voltage Ua is also zero, or in any case insufficient for the timepiece to operate. If barrel spring 1*a* is then wound, a moment is reached at which rotor 2*a* starts to rotate, and where voltages Ug and Ua start to increase.

Accumulator 10*a* is completely, or at least almost completely, discharged when the timepiece is stopped. When rotor 2*a* starts to rotate and voltage Ua reaches a sufficient value, accumulator 10*a* starts to charge by absorbing part of the electrical energy provided by generator 2. This excess of electrical energy is of course supplied by the barrel spring 1*a* and originates from the conversion by generator 2 of at least a part of the spring's mechanical energy.

If the motor torque provided by barrel spring 1*a* becomes less than the operating threshold torque of the timepiece, the electrical energy produced by generator 2 becomes insufficient to power the various circuits of regulator circuit 6 correctly. But, accumulator 10*a* is then at least partially charged, such that storage device 10 keeps voltage Ua at a value such that the components of regulator circuit 6 operate properly. The electrical energy necessary for such operation is then supplied, at least partially, by accumulator 10*a*.

Thus, the autonomy of this timepiece, which includes a storage device 10 capable of storing, in the form of electrical energy, a part of the mechanical energy contained in its barrel spring, is increased owing to means which enables this electrical energy to be used for operating the timepiece after the barrel spring is no longer sufficiently wound.

Nonetheless, a timepiece as described in EP Patent No. 0 875 807 only enables the instantaneous excess power to be stored compared to that necessary to make the timepiece operate properly. Thus, the use of this excess of instantaneous power to provide an additional indication, like for example the power reserve, would have the same drawbacks as those described in conjunction with EP Patent No. 0 762 243, namely directly using the power drawn from the generator, with the effect of greatly reducing the timepiece's autonomy, which is contrary to the desired objective.

SUMMARY OF THE INVENTION

In order to overcome the drawbacks of the prior art, the idea according to the invention is to provide a reliable power-reserve indication at the user's request, without disturbing the normal operation of the timepiece, i.e. while providing a correct time indication.

Within the scope of the present invention, it has been demonstrated that the electromagnetic braking device of the generator, with a full power-reserve, i.e. with the barrel spring completely wound, enables a relatively large mean power to be released. The idea is thus to modify the braking device so as to recuperate and store electrically the energy dissipated during braking periods, in a reasonable time period in order to be able to momentarily display an additional item of information, like for example, the power-reserve.

For this purpose, there are provided electrical energy accumulation means for storing the energy dissipated during the generator braking periods as well as actuating means for actuating, upon request, the power-reserve indicating means of the timepiece, owing to the previously stored electrical energy. In this way, the autonomy of the timepiece is not reduced, and, moreover, the necessary accumulation means are simple, reliable and of reduced size, like for example a capacitor with a value of the order of 10 microfarads.

The present invention therefore concerns a timepiece with a generator whose features are listed in claim 1.

Advantageous embodiments of the present invention form the subject of the dependent claims.

The present invention also concerns the method of indicating the power-reserve for such a timepiece.

BRIEF DESCRIPTION OF THE DRAWINGS

Other features and advantages of the present invention will appear more clearly upon reading the following detailed description of embodiments of the invention given solely by way of non-limiting example and illustrated by the annexed drawings, in which.

DESCRIPTION OF PREFERRED EMBODIMENTS

The invention proceeds, as already mentioned, from the general idea that consists in accumulating the electrical energy dissipated during the generator braking periods, in order to have sufficient energy to indicate, upon request, the power-reserve of a timepiece.

In fact, it has been demonstrated within the scope of the present invention that the energy dissipated during the generator braking periods represents a mean instantaneous power of approximately a microwatt (namely a microampere of mean current under one volt) that is insufficient for continuously powering a power-reserve indicator. The idea is to be able to accumulate, in a reasonable lapse of time, for example a few minutes, sufficient energy to momentarily display the power-reserve. A quantity of energy of between 40 and 80 microJoules has proved ample. This energy must also be able to be released in a short time lag, i.e. there must be available an instantaneous power that is considerably higher (up to a thousand times greater) than the mean dissipated braking power, depending upon the type of power-reserve indicator used.

Figure 1:
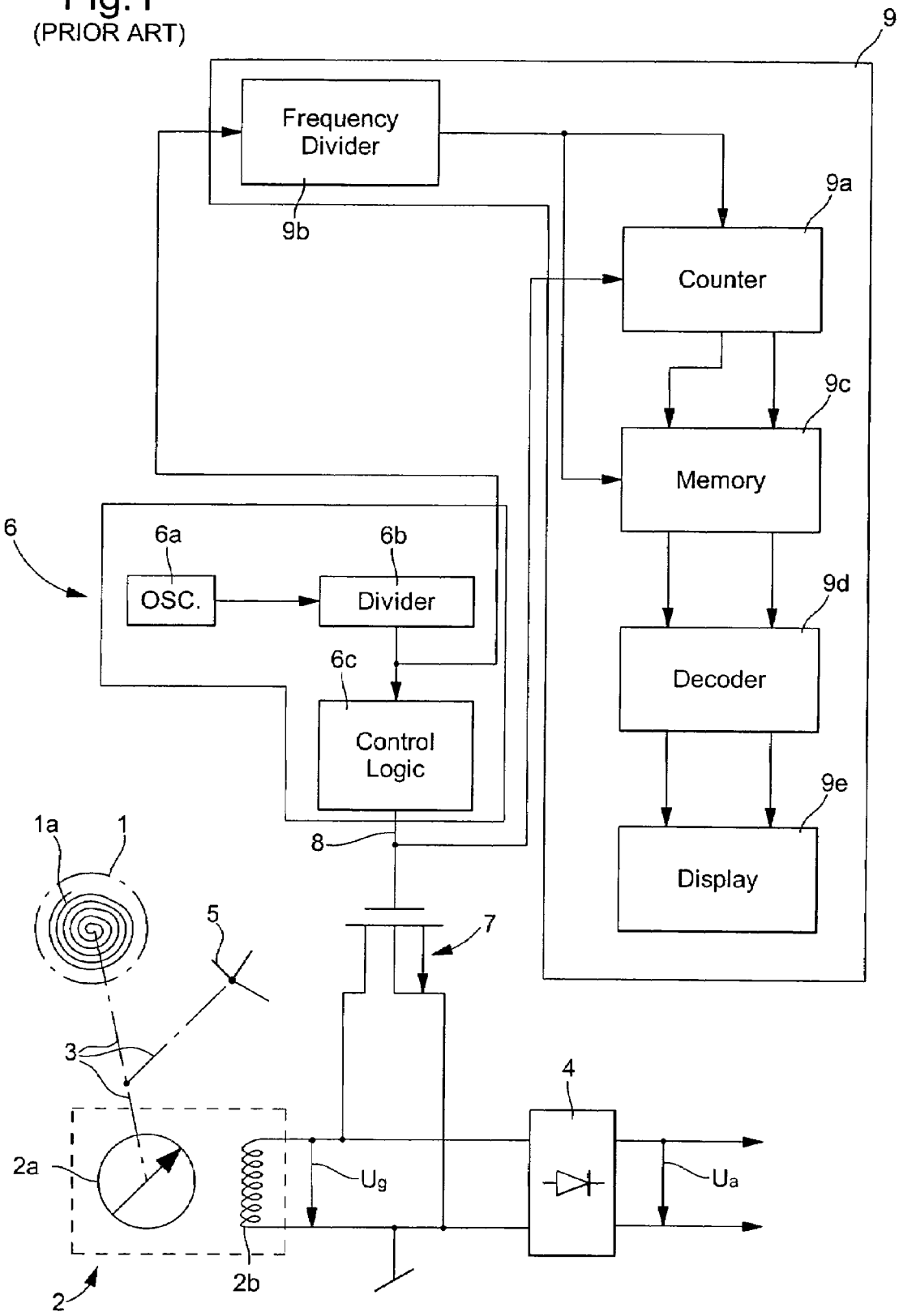
Fig.1 (PRIOR ART)
FIG. 1, already described, shows a timepiece having a generator with a power-reserve indicator according to the prior art.
Figure 2:
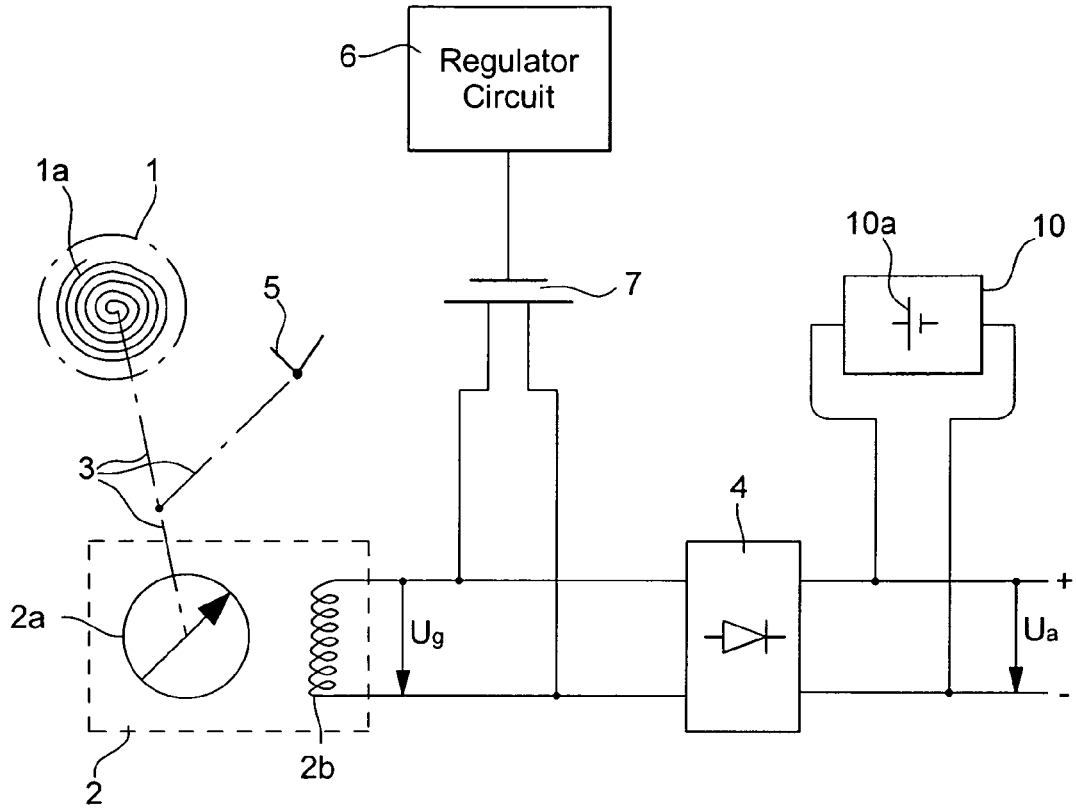
Fig.2 (PRIOR ART)
FIG. 2, already described, shows a timepiece having a generator with prolonged autonomy according to another prior art.
Figure 3:
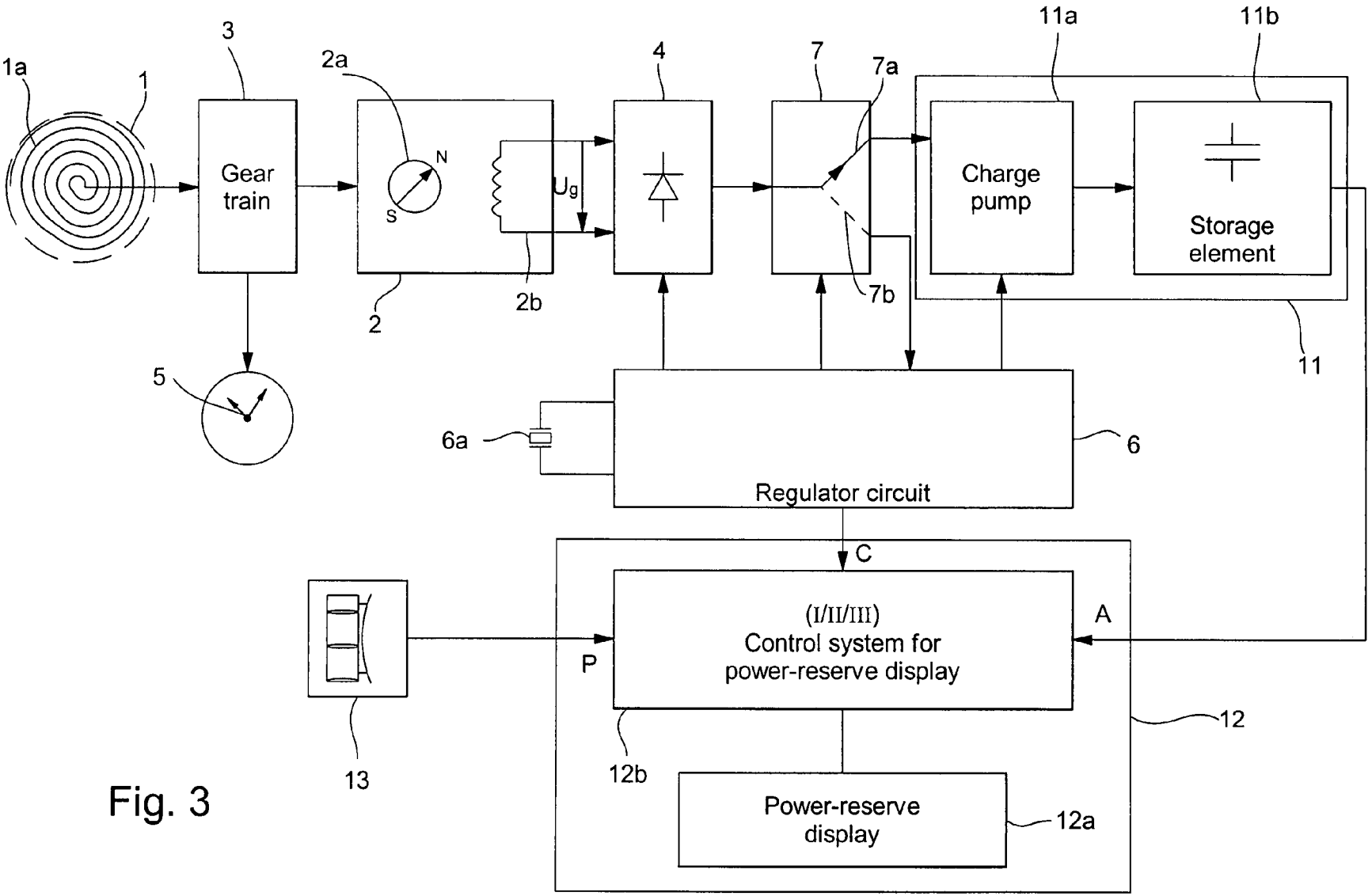
FIG. 3 shows a timepiece having a power-reserve indicator according to a preferred embodiment of the invention.

Reference will now be made to FIG. 3, which shows a simplified diagram of a timepiece according to a preferred embodiment of the invention. A certain number of elements can be seen that are identical to those presented within the scope of the prior art in FIGS. 1 and 2, such elements will not be detailed again here and their reference numerals remain unchanged.

Thus, there is again shown a timepiece fitted with a mechanical energy source formed by a barrel 1 which houses a barrel spring 1*a*. The barrel is mechanically coupled, on the one hand, to generator 2 whose alternating voltage Ug generated at its output, is rectified via an active rectifier 4, and, on the other hand, to time indication display means 5, conventionally hands, via gear trains 3 of the watch movement. The rotational speed of the hands is kept at a constant mean value owing to the monitoring circuit 6, or regulator circuit, for enslaving the frequency of generator 2 to a reference frequency, such that the speed of the hands corresponds to the speed required to obtain a correct time indication.

The timepiece further includes electrical energy accumulation means 11 arranged to be able to accumulate the electrical energy dissipated during braking periods of generator 2,—i.e. during short-circuits applied to the generator via switching means 7. Switching means 7 are actuated by regulator circuit 6 when the generator frequency is higher than the reference frequency, i.e. when the rotational speed of rotor 2*a* is higher than the hand speed corresponding to a correct time indication.

Thus, switching means 7 can occupy two positions, a first position 7*a*, in which generator 2 is connected to accumulation means 11 ensuring optimum impedance adaptation with the generator so as to draw maximum power instantaneously from the latter, which has the effect of braking it and a second position 7*b*, in which generator 2 is connected to regulator circuit 6 for monitoring the generator frequency with respect to a reference frequency corresponding to a correct time indication.

Accumulation means 11 are preferably formed by a voltage step-up 11*a* and an accumulation element 11*b*. The voltage step-up 11*a* can be, for example, a Dickson type charge pump, formed of a plurality of stages arranged in cascade. Each stage of the pump includes an active device, for example a diode or a diode-connected transistor, which leads the current in a single direction and a storage capacitor. It will of course be noted that other charge pumps could be used. Accumulation element 11*b* can be a simple storage capacitor whose charge increases a little more upon each braking. Given the yield of such a charge pump 11*a*, accumulation element 11*b*, preferably a storage capacitor having a capacity of the order of 10 microfarads at 3 or 4 volts, allows an energy of the order of 40 to 80 microJoules to be accumulated after several minutes braking.

It will be noted in this regard that once accumulation element 11*b* is charged, accumulation means 11 continues to ensure optimum impedance adaptation, and consequently braking of the generator.

According to an alternative embodiment, the timepiece includes an indicator, not shown here, arranged on the dial to indicate when accumulation element 11*b* is sufficiently charged to power a power-reserve indication device 12. This power-reserve indication device 12 includes power-reserve display means 12*a* and a control system 12*b* for said display means. Control system 12*b* has been shown independently here of regulator circuit 6, it will be noted however that it could just as well be integrated in regulator circuit 6.

The power-reserve display control system is actuated (signal P) by actuating means 13 of the timepiece accessible from the exterior, like for example a push-button called a "request button". The role of this control system is to provide accurate indication of the power-reserve (signal R) on the basis of a measurement (signal C) of the power-reserve transmitted by regulator circuit 6. The energy necessary for displaying the power-reserve is provided by the accumulation means (signal A).

Various methods can be implemented for measuring the power-reserve. A first method consists in providing control system 12*b* with means for counting the successive brakings over successive time periods of a determined duration and for elaborating a power-reserve display signal from the number of brakings occurring during these successive time periods.

A second method consists in providing control system 12*b* with means for counting the number of times that the generator is braked, means for measuring the length of time between each braking and for elaborating a power-reserve display signal as a function of the result of the length of time measurement.

A third method consists in providing control system 12*b* with means for transmitting via electrical coupling between generator 2 and electromechanical actuating means, a measurement of the mean current dissipated during braking periods supplying an indication of the power-reserve to the display means.

Figure 4A:
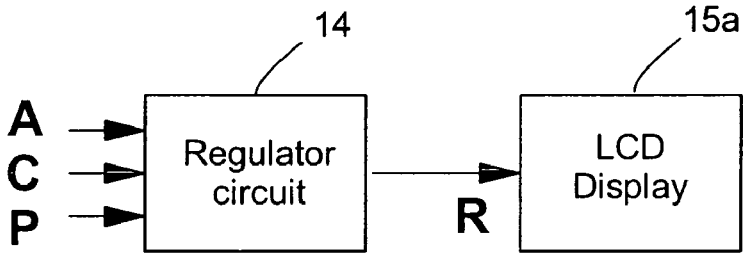
FIGS. 4*a*-4*c* show alternative embodiments of the power-reserve indicator means.
Figure 4B:
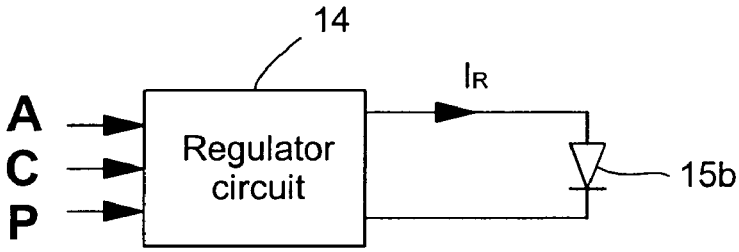
Figure 4C:
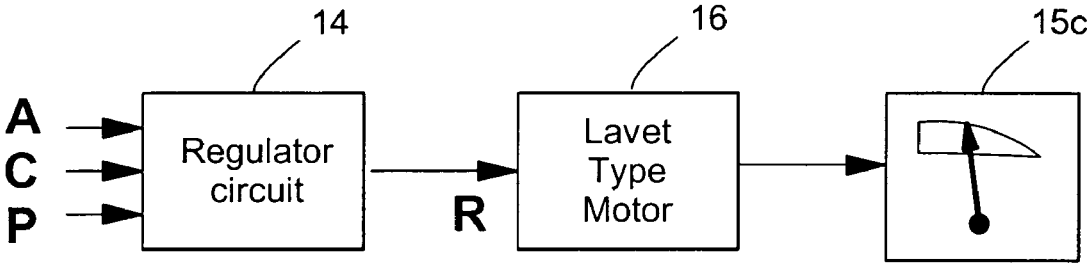
Figure 5:
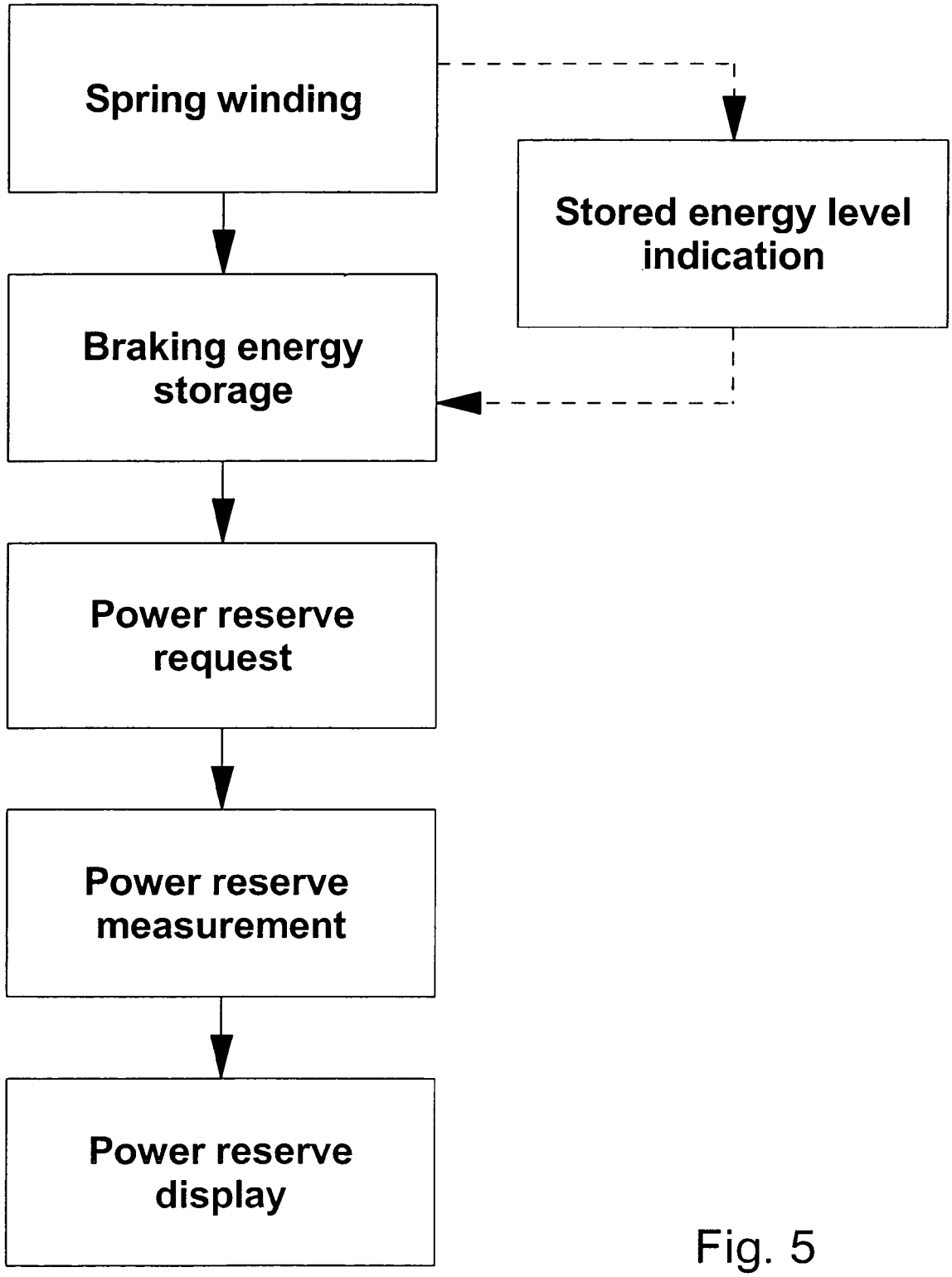
FIG. 5 shows an example of an implementation method for the power-reserve indication.

Several power-reserve display means can be used, depending upon the method chosen. Various examples of power-reserve indication devices are shown in FIGS. 4*a*-4*c*. In these Figures, control system 12*b* has been integrated in regulator circuit 6. A regulator circuit 14 can thus be seen receiving the various signals A, C and P respectively supplying the electrical energy necessary for the power-reserve display, the power-reserve indication and the request for such a power-reserve indication.

FIG. 4*a* shows a first example using digital power-reserve display means. Said display means are formed by an LCD (Liquid Crystal Display) type display 15*a* arranged on the dial of the timepiece. The power-reserve indication is preferably displayed as a percentage with respect to the maximum power-reserve, corresponding to the completely wound spring, or in remaining power-reserve hours. These display means can be used with one of the first two methods explained hereinbefore.

Preferably, the LCD display is left active for a determined period of time, sufficient to allow the user time to read the power-reserve indication after he has actuated the request push-button.

FIG. 4*b* shows a second example using optical power-reserve display means. Said display means are formed by a light-emitting diode 15*b* with high visible yield through an aperture made in the dial of the timepiece. In this case, regulator circuit 14 preferably delivers current pulses Ir, each of these pulses representing a percentage of the total power-reserve, for example 20%. Thus, 5 pulses represent 100% of the power-reserve, namely maximum power-reserve. These display means can be used with one of the first two methods explained hereinbefore.

FIG. 4*c* shows a third example using electromechanical power-reserve display means. Said display means are formed by an analogue display member, for example a hand 15*c*, moving opposite graduations representative of the power-reserve, arranged in a window in the dial of the timepiece. This analogue display member 15*c* is driven by a stepping motor 16, for example of the two-directional Lavet type, the latter being controlled by electric coupling with the generator during braking periods, in accordance with the third method explained hereinbefore.

A first variant of this third example consists in providing a power-reserve indication by means of a bi-directional Lavet motor (16) which automatically adapts the position of the analogue display member (15*c*) when this proves necessary (signal C) by means of a pulse (signal R), i.e. one step in one direction or the other depending upon whether the power-reserve is decreasing or increasing, using the energy accumulated (signal A) by the accumulation means. It is important to note that according to this first variant, no intervention by the user is necessary to obtain a power-reserve indication each time that the power-reserve varies by a predetermined quantity, corresponding for example to one step of the motor. Advantageously, the position of the power-reserve indicator is able to be adjusted manually (signal P) via a push-button, in order to correct any shift between the position of the motor and that of the indicator. In fact, such a shift may appear if there a shock occurs precisely while the motor is adapting the position of the analogue display member.

A second variant of this third example consists in providing a zero reset for analogue display member 15*c* when the request push-button is actuated. Thus, signal P received by regulator circuit 14 first of all commands the display member to be reset to zero, then, secondly, the power-reserve indication The display member then remains fixed in the power-reserve indication position until the next request by the user.

A third variant of this third example consists simply in adjusting the position of the display member upon each request made by the user without any prior zero reset.

The present invention also concerns the method of indicating the power-reserve for such a timepiece. The method includes a preliminary step of winding the barrel spring sufficiently such that the timepiece can operate properly. With the exception of the first variant of the third example presented in FIG. 4*c*, the method then includes the following steps of:

1. accumulating electrical energy by charging the accumulation means with the power dissipated during successive generator brakings;
2. requesting a power-reserve indication by actuating the actuating means provided for this purpose;
3. measuring the power-reserve indication in accordance with any of the aforementioned methods;
4. displaying the measured indication with the corresponding power-reserve display means.

An intermediate step 1*b* (between steps 1 and 2) can be provided. This step 1*b* consists in indicating when the level of accumulated energy is sufficient to provide a power-reserve indication.

The method for indicating the power-reserve for implementing the first variant of the third example presented in FIG. 4*c*, step 2 concerning the request made via the actuating means is replaced by a step of:

2. automatically requesting a power-reserve indication.

It is clear that various modifications and/or improvements evident to those skilled in the art can be made to the various embodiments of the invention described in the present description without departing from the scope of the invention defined by the annexed claims. In particular, the present invention is not limited solely to the power-reserve measurement methods explained hereinbefore not to the various aforementioned examples of power-reserve display means.

It will also be noted that other accumulation means can be used for storing the electrical energy dissipated during the generator braking periods. As regards the actuating means, it is possible to use by way of alternative, a shock detector on the timepiece glass, or even a stem-crown.

It will further be noted that it is possible to increase the autonomy of the timepiece according to the invention by providing an additional storage device like that disclosed in EP Patent No. 0 875 807, this additional device being charged by means of the excess electrical energy with respect to the energy necessary for proper operation, when the generator is not being braked.

What is claimed is:

1. A timepiece including a mechanical power source coupled, on the one hand, to first time related information display means and, on the other hand, to a generator, a regulator circuit for enslaving the generator frequency to a reference frequency, said regulator circuit including switching means arranged for electrically braking the generator when the generator frequency is higher than the reference frequency, and second power-reserve display means controlled by means for measuring the power-reserve, wherein the timepiece further includes means for accumulating the electrical energy dissipated during generator braking periods and means for actuating said second display means to display the power-reserve by means of the electrical energy accumulated by said accumulation means.

2. The timepiece according to claim 1, wherein said electrical energy accumulation means are formed by a voltage step-up circuit electrically connected to the generator during braking periods and controlled by the regulator circuit so as to accumulate the energy dissipated during said periods in a storage capacitor.

3. The timepiece according to claim 2, wherein the generator includes at least one coil and wherein the power-reserve measuring means include an electrically controlled motor controlled by said actuating means, for providing, as a function of an electrical variable transmitted during the electrical coupling, power-reserve information to the second display means.

4. The timepiece according to claim 1, wherein the actuating means are a control member accessible from outside the timepiece.

5. The timepiece according to claim 4, wherein the generator includes at least one coil and wherein the power-reserve measuring means include an electrically controlled motor controlled by said actuating means, for providing, as a function of an electrical variable transmitted during the electrical coupling, power-reserve information to the second display means.

6. The timepiece according to claim 1, wherein the power-reserve measuring means include means for fixing successive time periods of a predetermined length, means for counting, during each of said fixed periods, the number of times that the generator is braked by the switching means and means controlled by the actuating means to provide, as a function of the result of counting, power-reserve information to the second display means.

7. The timepiece according to claim 6, wherein the second display means are optical means formed by a light emitting diode with a high yield supplying a visual power reserve indication by means of light pulses.

8. The timepiece according to claim 1, wherein the power-reserve measuring means include means for counting the number of times that the generator is braked by the switching means, means for measuring the period of time between each braking and means controlled by the actuating means, for providing, as a function of the result of the period of time measurement, power-reserve information to the second display means.

9. The timepiece according to claim 8, wherein the second display means are optical means formed by a light emitting diode with a high yield supplying a visual power reserve indication by means of light pulses.

10. The timepiece according to claim 1, wherein the generator includes at least one coil and wherein the power-reserve measuring means include an electrically controlled motor controlled by said actuating means, for providing, as a function of an electrical variable transmitted during the electrical coupling, power-reserve information to the second display means.

11. The timepiece according to claim 10, wherein the second display means are electromechanical means formed by an analogue member driven by said electrically controlled motor.

12. The timepiece according to claim 1, wherein indicator means are provided for indicating when the energy stored by the accumulation means is sufficient to display the power-reserve.

13. A timepiece including a mechanical energy source coupled to first time information display means and to a generator, a regulator circuit for enslaving the generator frequency to a reference frequency, said regulator circuit including switching means arranged for electrically braking the generator when the generator frequency is higher than the reference frequency, and second power-reserve display means controlled by power-reserve measuring means, wherein the timepiece further includes means for accumulating the electrical energy dissipated during the generator braking periods, and in that said power-reserve measuring means automatically adapt the position of said second display means to display the power-reserve by means of the electrical energy accumulated by said accumulation means.

14. The timepiece according to claim 13, wherein the generator includes at least one coil and wherein the power-reserve measuring means include an electrically controlled motor controlled by said regulator circuit, to provide, as a function of an electrical variable transmitted during electrical coupling, power-reserve information to the second display means.

15. The timepiece according to claim 14, wherein the second display means are electromechanical means formed by an analogue member driven by said electrically controlled motor.

16. The timepiece according to claim 13, wherein it further includes adjustment means for manually adjusting the position of said analogue display means.

17. The timepiece according to claim 13, wherein indicator means are provided for indicating when the energy stored by the accumulation means is sufficient to display the power-reserve.

* * * * *